US008523593B2

(12) United States Patent
Ko

(10) Patent No.: US 8,523,593 B2
(45) **Date of Patent: *Sep. 3, 2013**

(54) STANDARD RECEPTACLE CONNECTOR WITH PLUG DETECTING FUNCTIONS AND SINK-TYPE RECEPTACLE CONNECTOR WITH PLUG DETECTING FUNCTIONS

(71) Applicant: Advanced Connectek Inc., New Taipei (TW)

(72) Inventor: Wen-Chih Ko, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/762,457

(22) Filed: Feb. 8, 2013

(65) Prior Publication Data

US 2013/0149910 A1 Jun. 13, 2013

Related U.S. Application Data

(62) Division of application No. 13/097,129, filed on Apr. 29, 2011, now Pat. No. 8,393,912.

(30) Foreign Application Priority Data

Aug. 31, 2010 (TW) ..... 99129239 A

(51) Int. Cl.
*H01R 4/50* (2006.01)

(52) U.S. Cl.
USPC ..... 439/345

(58) Field of Classification Search
USPC ..... 439/345, 638, 188, 620.11, 620.01, 439/63
See application file for complete search history.

(56) References Cited

U.S. PATENT DOCUMENTS

| | | | | |
|---|---|---|---|---|
| 6,296,492 | B1 * | 10/2001 | Fujimoto et al. | 439/63 |
| 7,241,157 | B2 * | 7/2007 | Zhuang et al. | 439/188 |
| 7,575,454 | B1 | 8/2009 | Aoki et al. | |
| 8,393,912 | B2 * | 3/2013 | Ko | 439/345 |
| 2009/0061671 | A1 | 3/2009 | Qin et al. | |
| 2009/0111330 | A1 | 4/2009 | Lin et al. | |

* cited by examiner

*Primary Examiner* — Jean F Duverne
(74) *Attorney, Agent, or Firm* — Alan Kamrath; Kamrath IP Lawfirm, P.A.

(57) ABSTRACT

A standard receptacle connector has an insulating housing, multiple first terminals, multiple second terminals, a plug detecting terminal and a shell. The first and second terminals and the plug detecting terminal are mounted on the insulating housing. The shell covers the insulating housing and all of the terminals. The plug detecting terminal is capable of being connected to a controlling circuit incorporated in a PCB on which the standard receptacle connector is mounted and selectively activates the controlling circuit to provide power to an external plug connector that is inserted in and connected to the standard receptacle connector.

20 Claims, 20 Drawing Sheets

STANDARD RECEPTACLE CONNECTOR WITH PLUG DETECTING FUNCTIONS AND SINK-TYPE RECEPTACLE CONNECTOR WITH PLUG DETECTING FUNCTIONS

The present invention is a divisional application of a U.S. patent application Ser. No. 13/097,129 filed on Apr. 29, 2011.

BACKGROUND OF THE INVENTION

1. Field of the Invention

The present invention relates to a connector, and more particularly to a standard receptacle connector with plug detecting functions and a sink-type receptacle connector with plug detecting functions. Each aforementioned receptacle connector complies with the USB protocol and is capable of detecting and providing power for an external plug connector inserted in and connected to the receptacle connector.

2. Description of Related Art

Conventional Universal Serial Bus (USB) 2.0 connectors are widely used in various electronic devices. Most computer peripherals are equipped with USB connectors. Because electronic devices are constantly developed to increase transmission speed thereof, the USB 2.0 protocol does not meet the current transmission speed requirement of new electronic devices. Therefore, the USB Implementers Forum sets forth new USB 3.0 protocol for higher data transmission speed.

The USB 3.0 protocol is compatible with the USB 2.0 protocol and theoretically provides 5 Gbps of data transmission speed.

Generally, USB receptacle connectors are mounted on printed circuit boards (PCBs) such as motherboards of desktops and laptops and have a power terminal to provide a connected external electronic device with electric power. Current PCBs are designed to selectively switch to a power-saving mode. Under the power-saving mode, the PCB cuts off electric power supplied to devices or interface cards connected to the PCB. Accordingly the electric power supplied to the USB receptacle connectors is also cut off.

In particular aspects, some users have a demand that the PCBs of the desktops and laptops under the power-saving mode still provide electric power to external electronic devices through the USB receptacle connectors.

However, a conventional USB 3.0 receptacle connector is not designed to timely detect the insertion of a USB plug connector to start to supply electric power under the power-saving mode of a PCB on which the USB 3.0 receptacle connector is mounted.

To overcome the shortcomings, the present invention provides a standard receptacle connector with plug detecting functions and a sink-type receptacle connector with plug detecting functions to mitigate or obviate the aforementioned problems.

SUMMARY OF THE INVENTION

The main objective of the invention is to provide a standard receptacle connector with plug detecting functions and a sink-type receptacle connector with plug detecting functions. Each aforementioned receptacle connector complies with the USB protocol and is capable of detecting and providing power for an external plug connector inserted in and connected to the receptacle connector.

A standard receptacle connector in accordance with the present invention comprises an insulating housing, multiple first terminals, multiple second terminals, a plug detecting terminal and a shell. The first and second terminals and the plug terminal are mounted on the insulating housing. The shell covers the insulating housing and all of the terminals. The plug detecting terminal is capable of being connected to a controlling circuit incorporated in a PCB on which the standard receptacle connector is mounted and selectively activates the controlling circuit to provide power to an external plug connector that is inserted in and connected to the standard receptacle connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
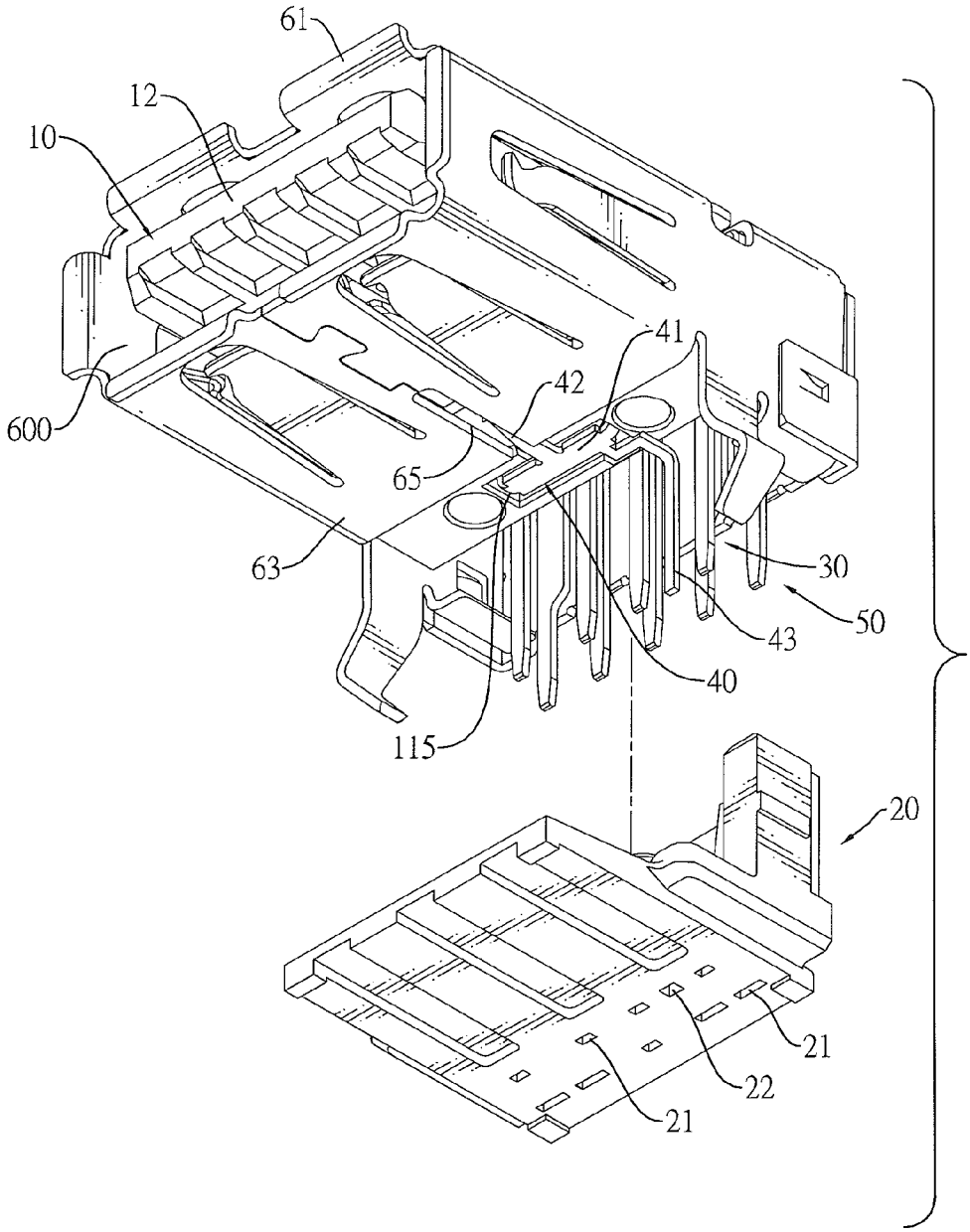
FIG. 1 is a partially exploded perspective view of a first embodiment of a standard receptacle connector with plug detecting functions in accordance with the present invention.
Figure 2:
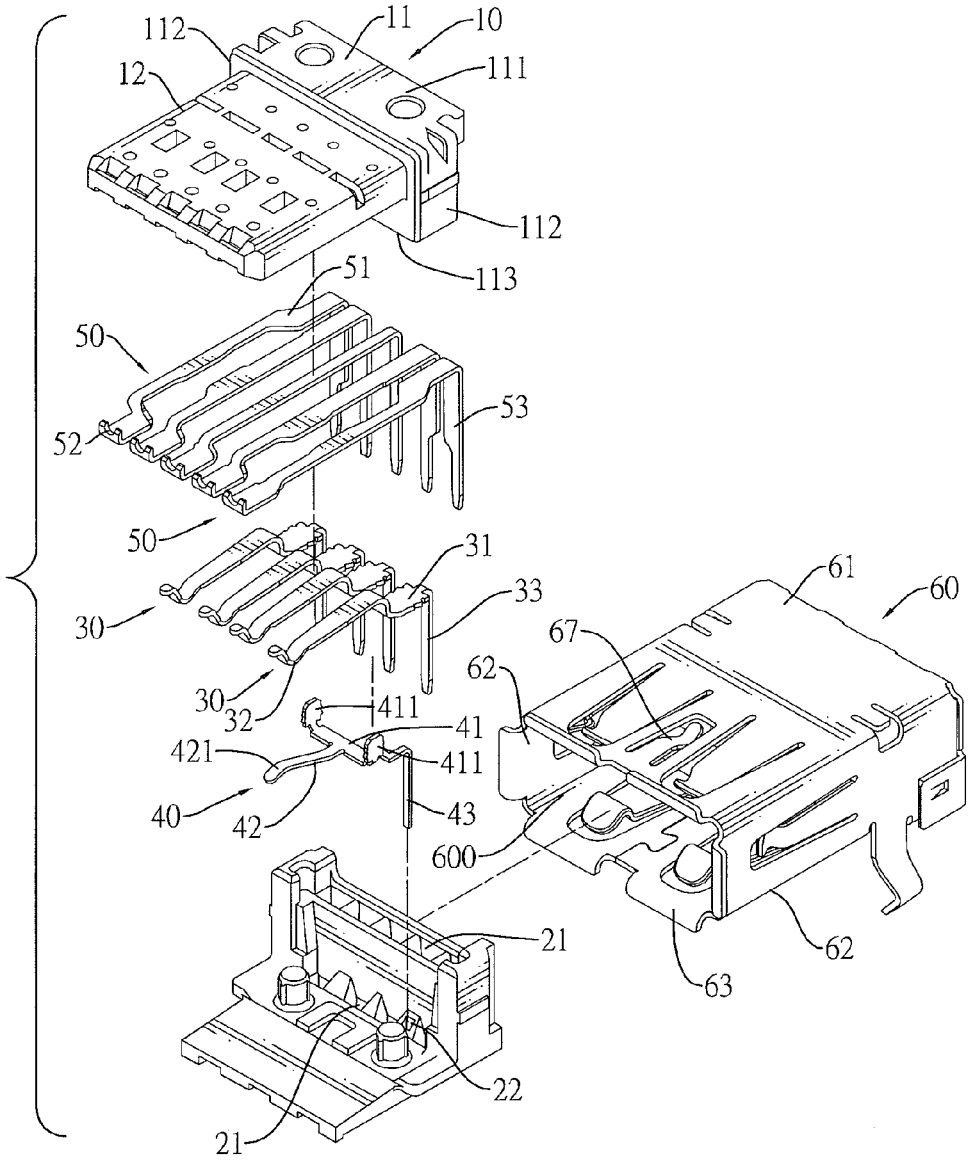
FIG. 2 is an exploded perspective view of the standard receptacle connector in FIG. 1.
Figure 3:
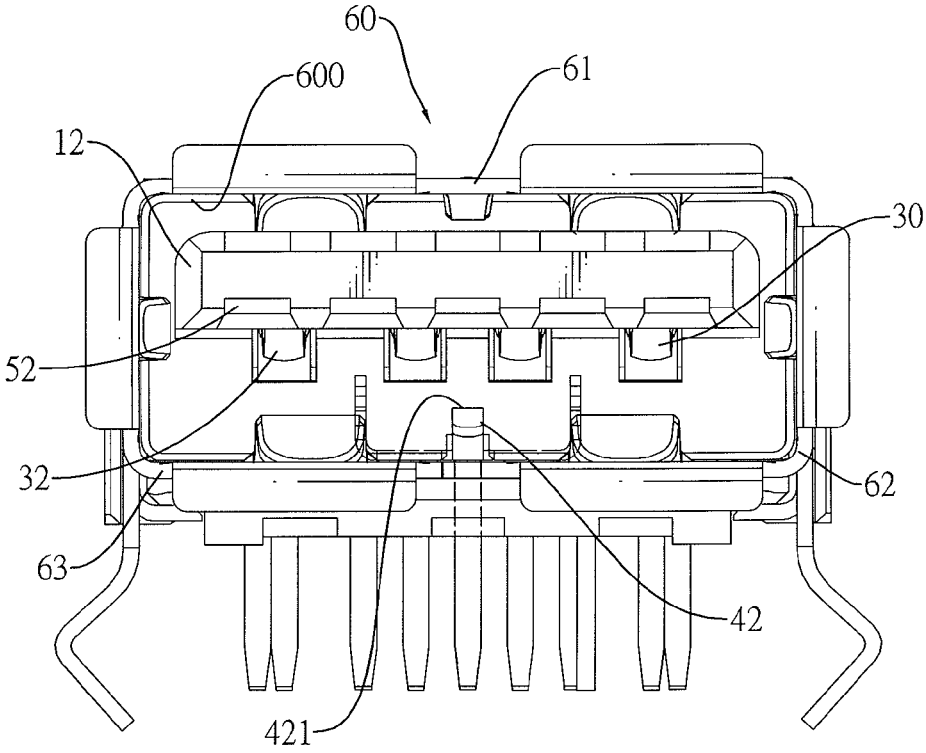
FIG. 3 is a front view of the standard receptacle connector in FIG. 1.
Figure 4:
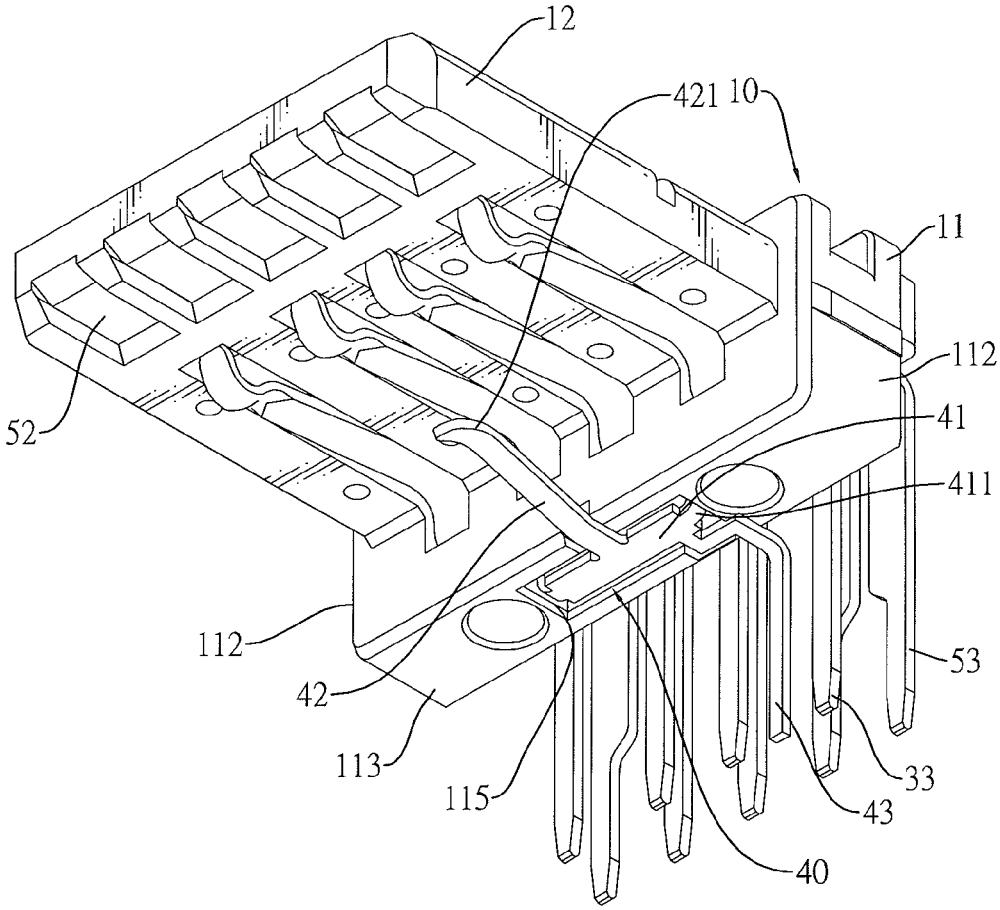
FIG. 4 is a perspective view of the receptacle connector in FIG. 1, omitting the shell and the protection bracket.

With reference to FIGS. 1 to 4, a first embodiment of a standard receptacle connector with plug detecting functions in accordance with the present invention is compatible with the USB 3.0 standard-A-type receptacle connector and may be connected to a plug connector. The USB 3.0 specification disclosing various types of USB 3.0 receptacle and plug connectors has been released and published on the USB-IF website: "http://www.usb.org/developers/docs/" which is incorporated herein for reference.

The standard receptacle connector comprises an insulating housing (10), multiple first terminals (30), multiple second terminals (50), a plug detecting terminal (40), a shell (60) and a protection bracket (20).

The insulating housing (10) has a base (11) and a tongue (12). The base (11) has a front, a rear, a top (111), a bottom (113) and two opposite sides (112) and further has a mounting slot (115). The mounting slot (115) is defined in the bottom (113) of the base (11).

The tongue (12) is formed on and protrudes forward from the front of the base (11) and has a bottom surface.

The first terminals (30) are mounted on the insulating housing (10) and are capable of implementing USB 2.0 protocol. Each first terminal (30) has a first mounting section (31), a first contacting section (32) and a first soldering section (33).

The first mounting section (31) is mounted on the base (11).

The first contacting section (32) is formed on and protrudes forward from the first mounting section (31) and is mounted on the bottom surface of the tongue (12).

The first soldering section (33) is formed on and protrudes down from the first mounting section (31).

The second terminals (50) are mounted on the insulating housing (10) and are capable of cooperating with the first terminals (30) to implement USB 3.0 protocol. Each second terminal (50) has a second mounting section (51), a second contacting section (52) and a second soldering section (53).

The second mounting section (51) is mounted on the base (11).

The second contacting section (52) is formed on and protrudes forward from the second mounting section (51) and is mounted on the bottom surface of the tongue (12).

The second soldering section (53) is formed on and protrudes down from the second mounting section (51).

The plug detecting terminal (40) is mounted on the bottom (113) of the base (11) of the insulating housing (10) and has a mounting segment (41), a resilient detecting arm (42) and a soldering segment (43).

The mounting segment (41) is mounted in the mounting slot (115) of the bottom of the base (11) of the insulating housing (10) and has two side ends and two embedding tabs (411). The embedding tabs (411) are formed respectively on and protrude upward from the side ends of the mounting segment (41) and are embedded in the base (11). Each embedding tab (411) has multiple teeth formed on the embedding tab (411) and biting the base (11).

The resilient detecting arm (42) is formed on and protrudes forward from the mounting segment (41) and has a distal end and a contacting protrusion (421). The contacting protrusion (421) is formed on the distal end of the resilient detecting arm (42) and protrudes toward the tongue (12) of the insulating housing (10).

The soldering segment (43) is formed on and protrudes down from the mounting segment (41).

The shell (60) may be made of metal, covers the insulating housing (10), has a cavity (600) and may further have a top plate (61), two opposite side plates (62), a bottom plate (63), a resilient tightening tab (67) and an open slot (65).

The cavity (600) is defined in the shell (60) and covers the insulating housing (10), the first terminals (30), the second terminals (50) and the plug detecting terminal (40).

The side plates (62) are formed oppositely on and protrude down from the top plate (61).

The bottom plate (63) is formed between the side plates (62).

The resilient tightening tab (67) is formed on the top plate (61) and protrudes toward the cavity (600).

The open slot (65) is defined through the shell (60), may be defined through one of the top plate (61), side plates (62) and bottom plate (63) and is aligned with the resilient detecting arm (42) of the plug detecting terminal (40) so that the resilient detecting arm (42) selectively moves through the open slot (65).

The protection bracket (20) is mounted under the base (11) of the insulating housing (10) and has multiple through holes (21, 22). The through holes (21, 22) are defined through the protection bracket (20) and are mounted respectively around the first soldering sections (33), second soldering sections (53) and soldering segment (43).

Figure 5:
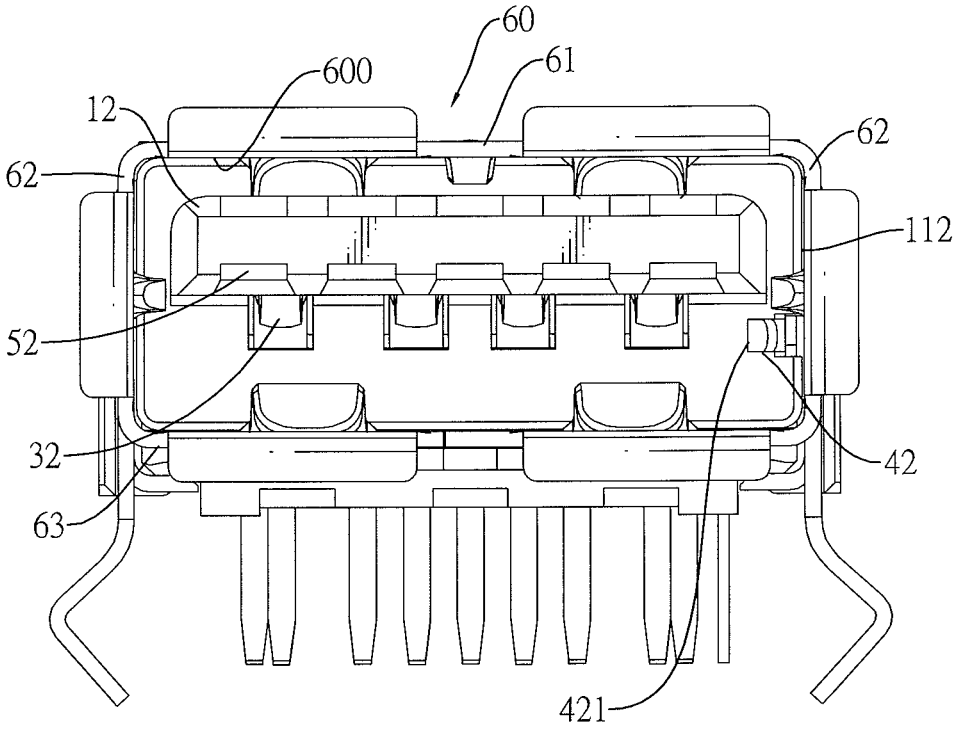
FIG. 5 is a front view of a second embodiment of the standard receptacle connector in accordance with the present invention.
Figure 6:
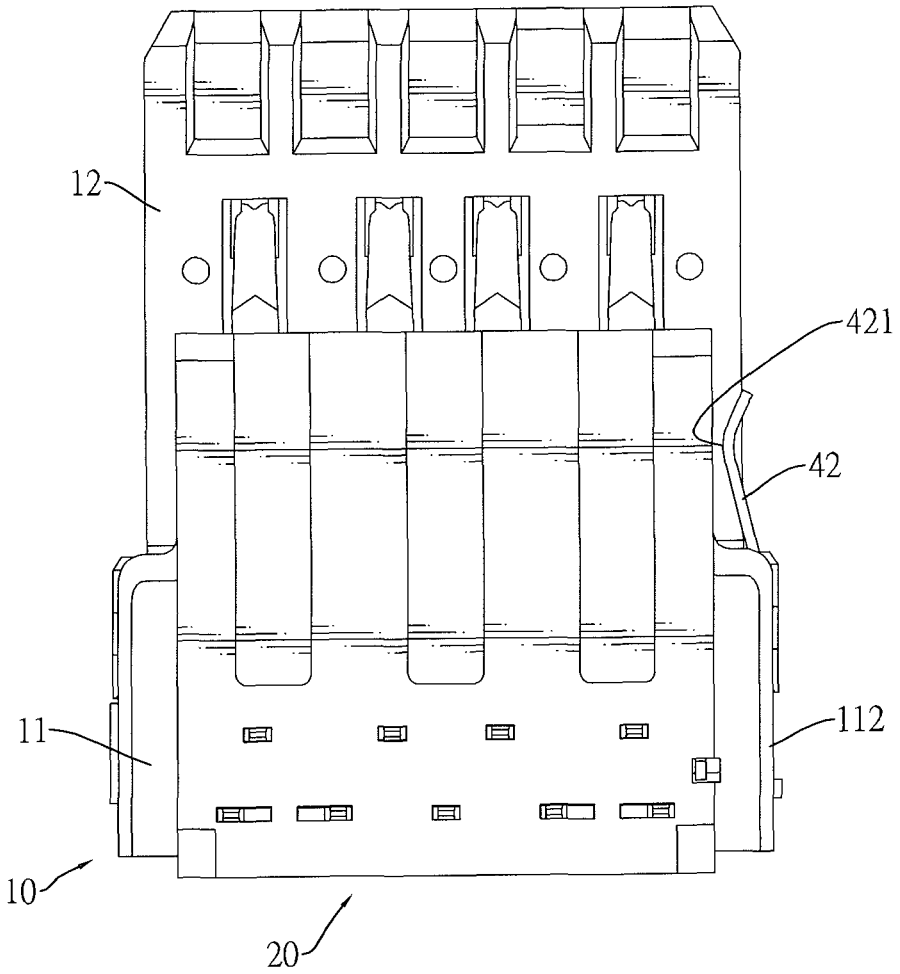
FIG. 6 is a bottom view of the standard receptacle connector in FIG. 5, omitting the shell.
Figure 7:
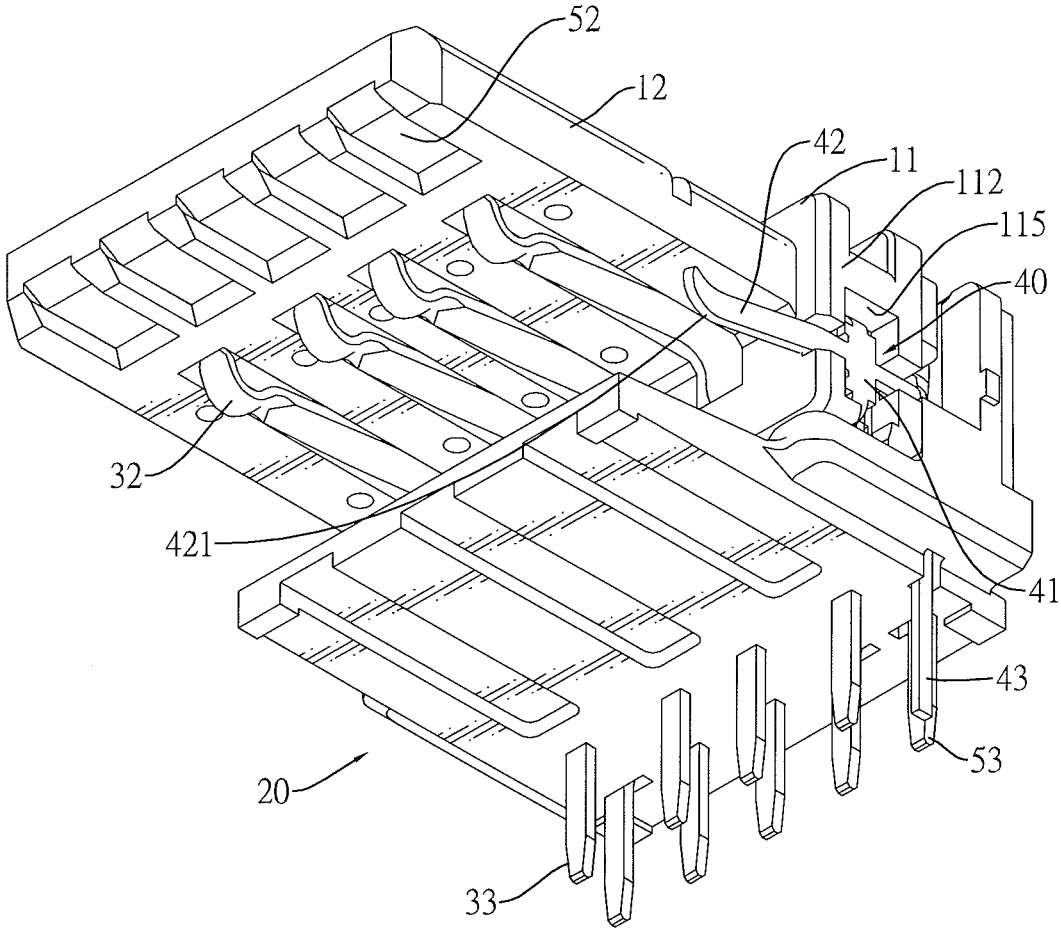
FIG. 7 is a perspective view of the standard receptacle connector in FIG. 6.

With reference to FIGS. 5 to 7, a second embodiment of the standard receptacle connector in accordance with the present invention is similar to the first embodiment and has several modifications. The mounting slot (115) is defined on one side (112) of the base (11) of the insulating housing (10). The mounting segment (41) of the plug detecting terminal (40) is mounted in the mounting slot (115).

Figure 8:
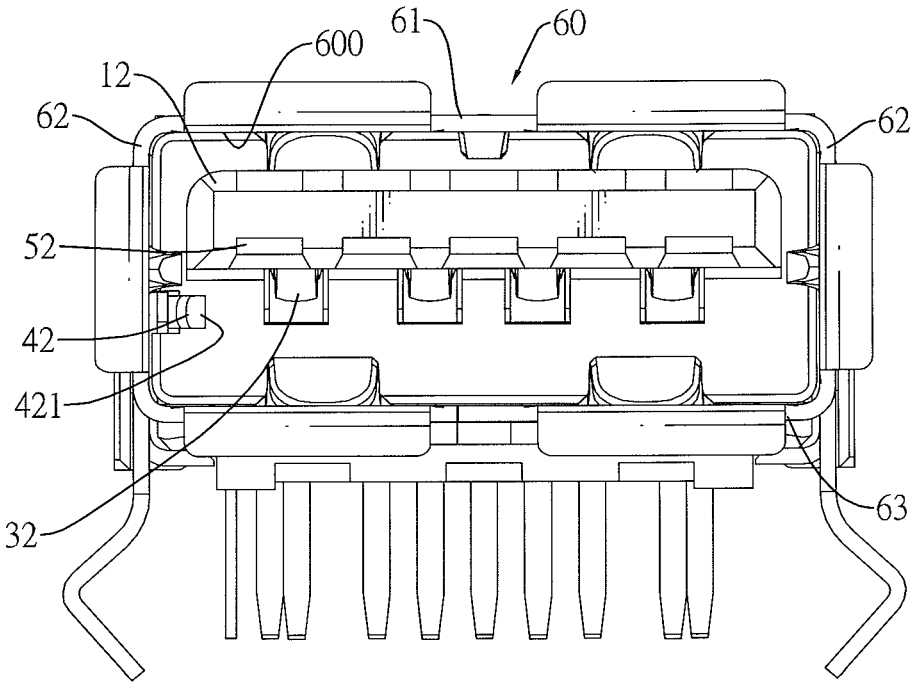
FIG. 8 is a front view of a third embodiment of the standard receptacle connector in accordance with the present invention.
Figure 9:
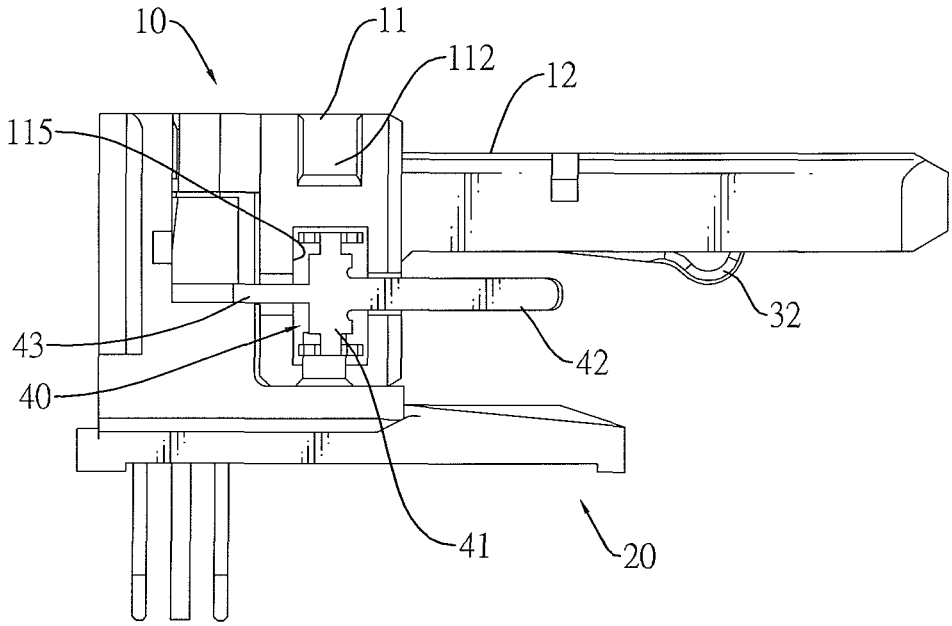
FIG. 9 is a side view of the standard receptacle connector in FIG. 8, omitting the shell.
Figure 10:
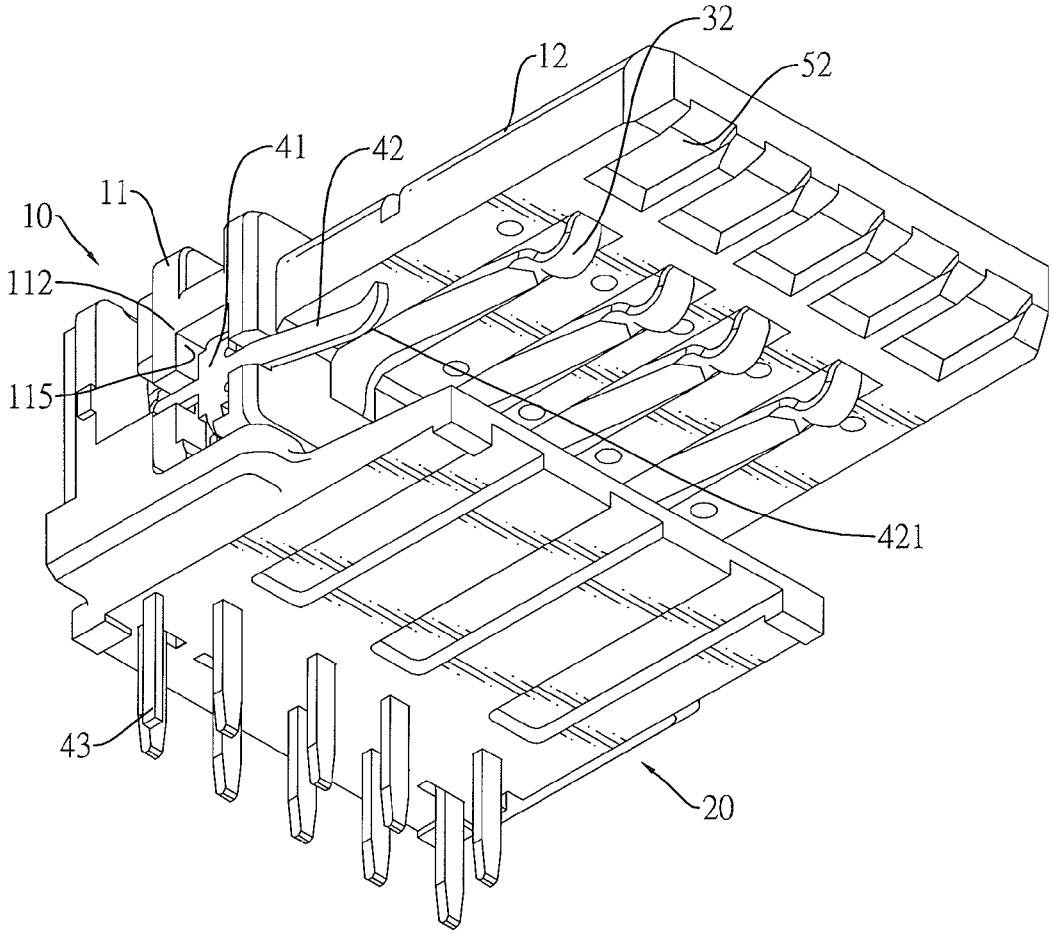
FIG. 10 is a perspective view of the standard receptacle connector in FIG. 9.

With reference to FIGS. 8 to 10, a third embodiment of the standard receptacle connector in accordance with the present invention is similar to the first embodiment and has several modifications. The mounting slot (115) is defined in the other side (112) of the base (11) of the insulating housing (10). The mounting segment (41) of the plug detecting terminal (40) is mounted in the mounting slot (115).

Figure 11:
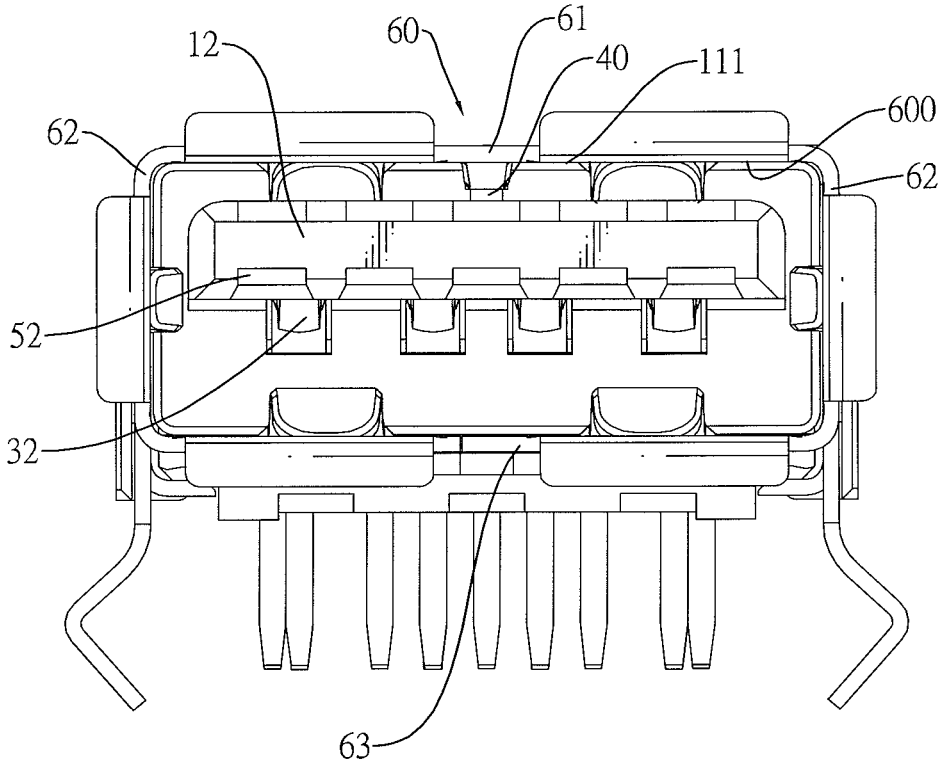
FIG. 11 is a front view of a fourth embodiment of the standard receptacle connector in accordance with the present invention.
Figure 12:
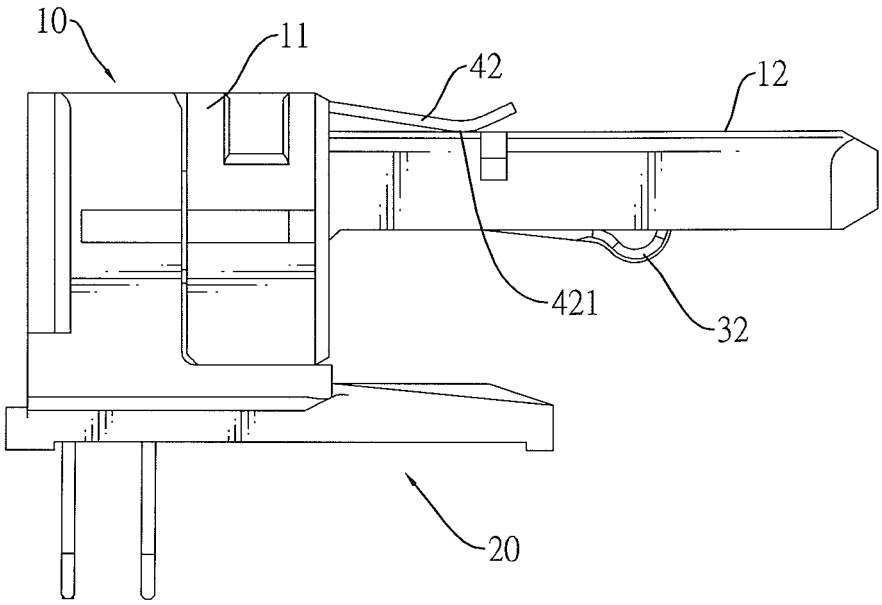
FIG. 12 is a side view of the standard receptacle connector in FIG. 11, omitting the shell.
Figure 13:
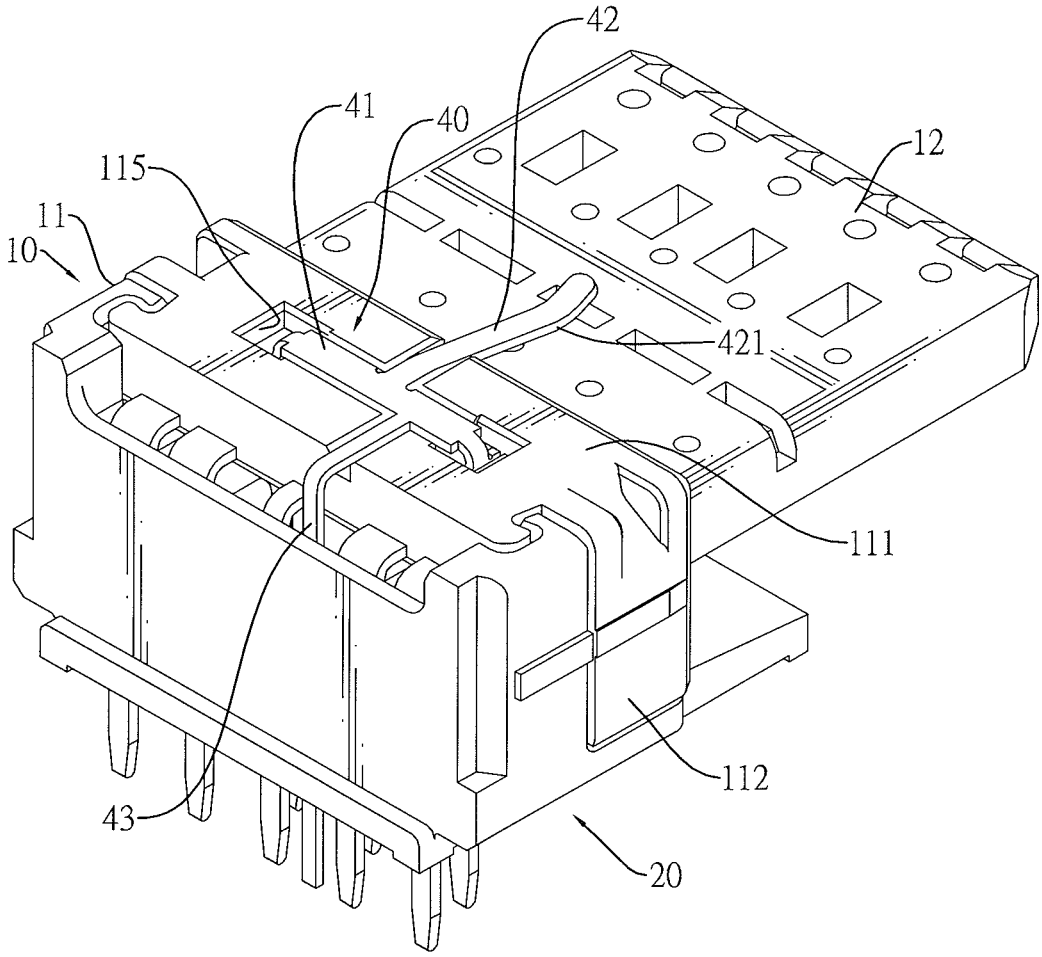
FIG. 13 is a perspective view of the standard receptacle connector in FIG. 12.
Figure 14:
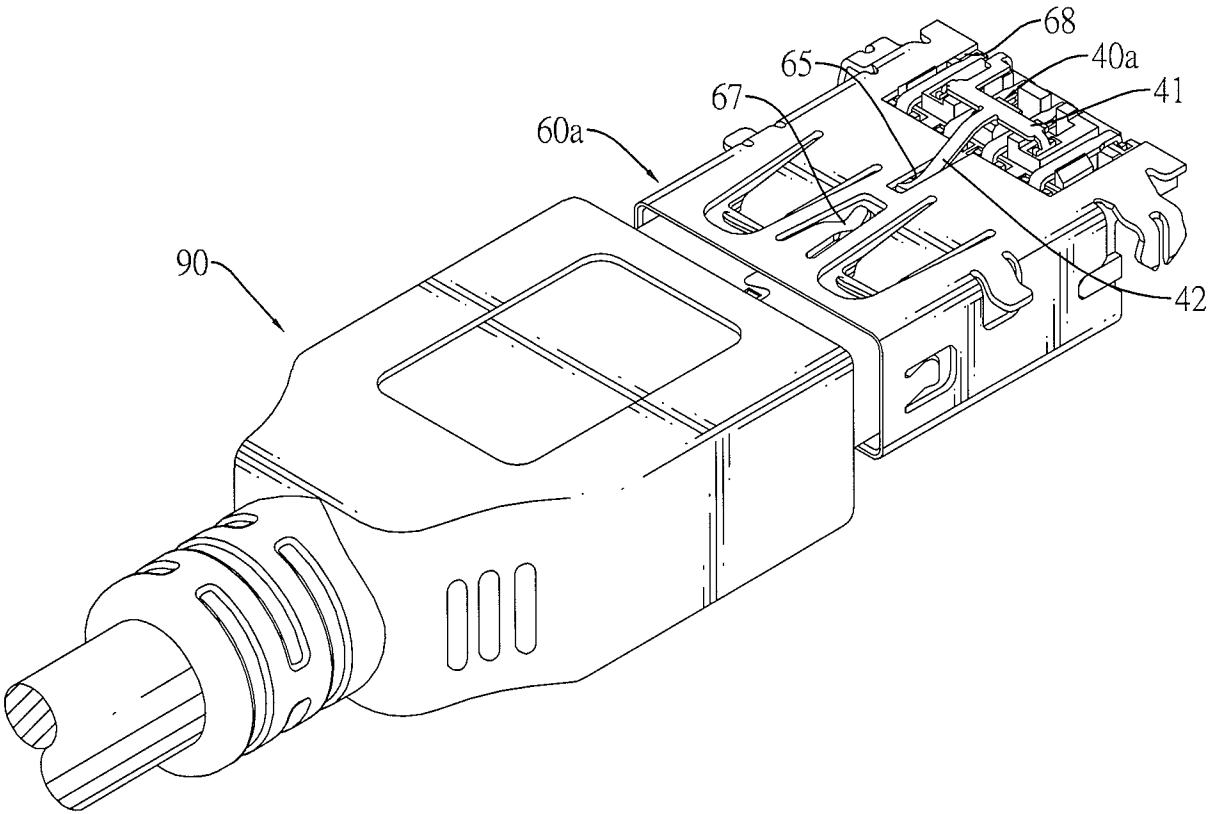
FIG. 14 is a perspective view of a first embodiment of a sink-type receptacle connector with plug detecting functions in accordance with the present invention when connected to a plug connector.
Figure 15:
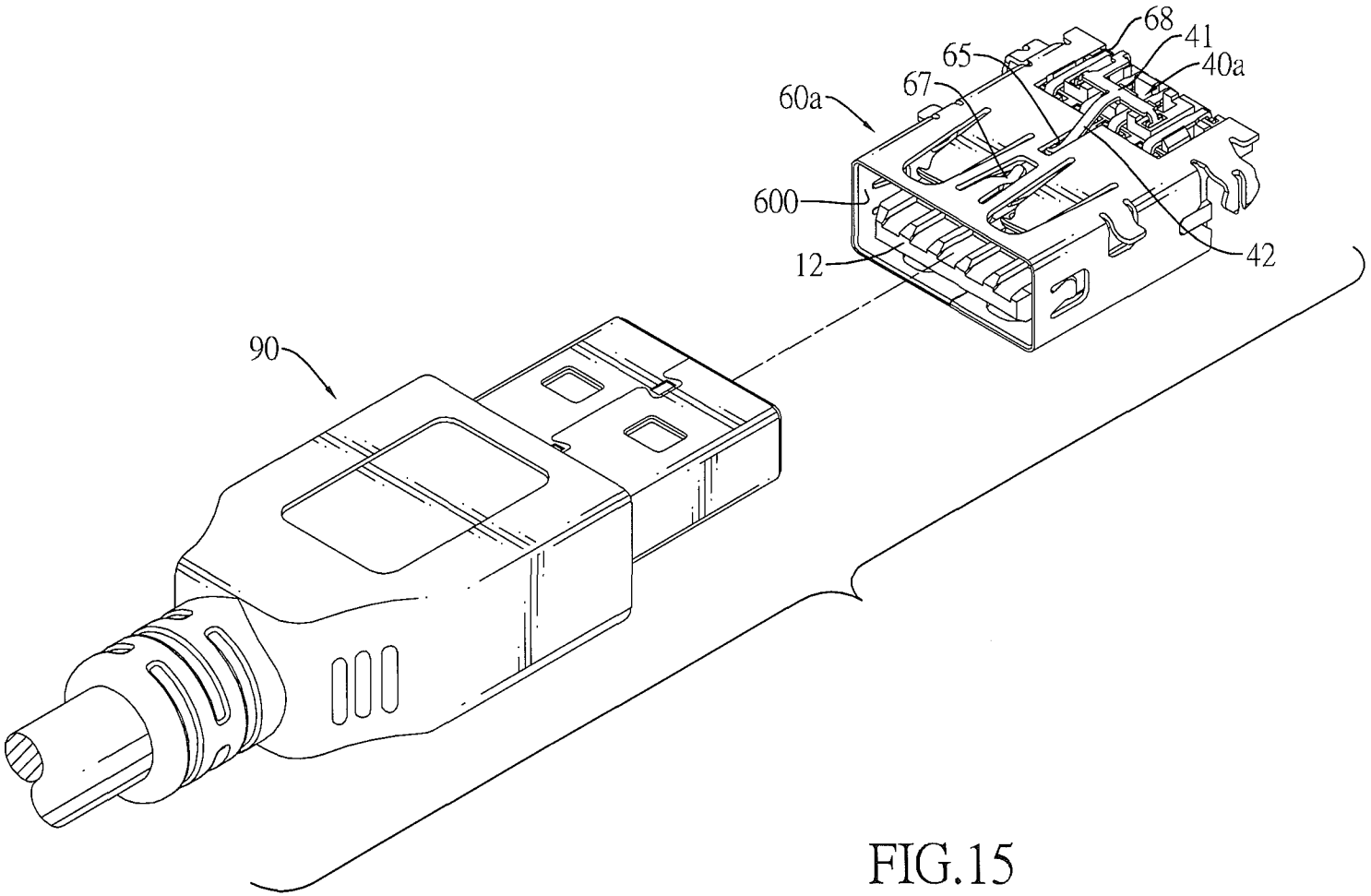
FIG. 15 an exploded perspective view of the sink-type receptacle connector and plug connector in FIG. 14.
Figure 16:
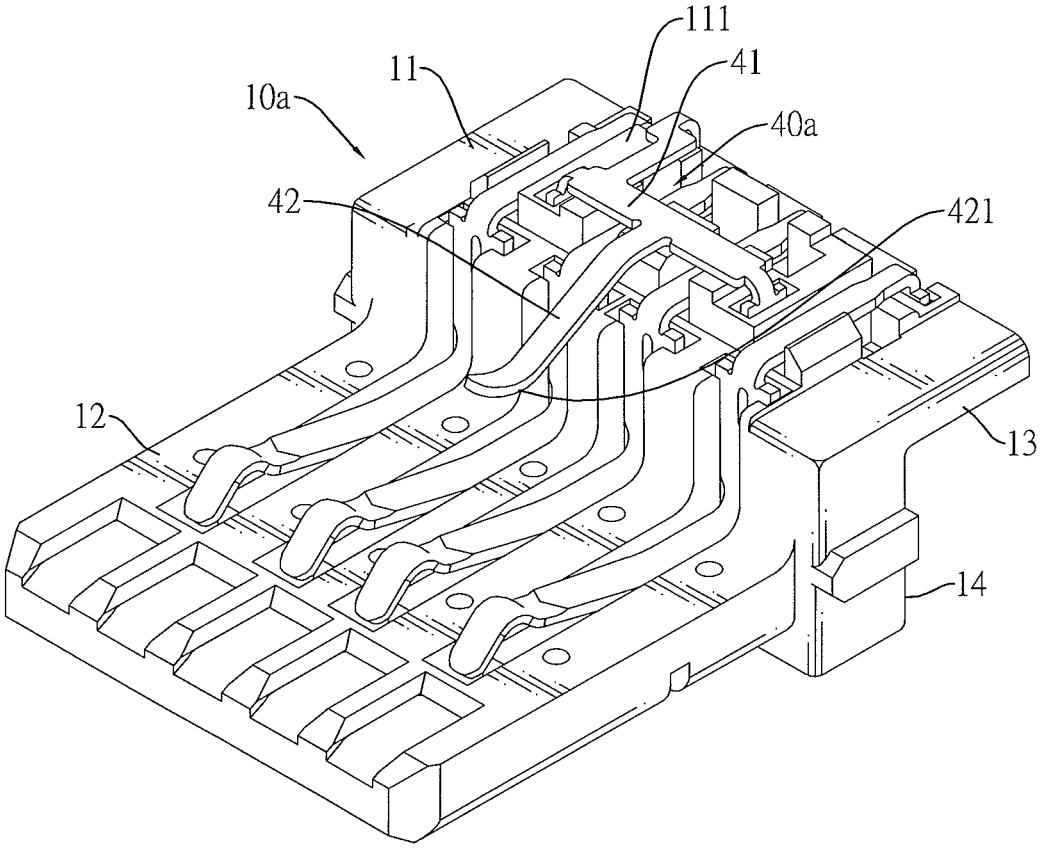
FIG. 16 is a perspective view of the sink-type receptacle connector in FIG. 14, omitting the shell.
Figure 17:
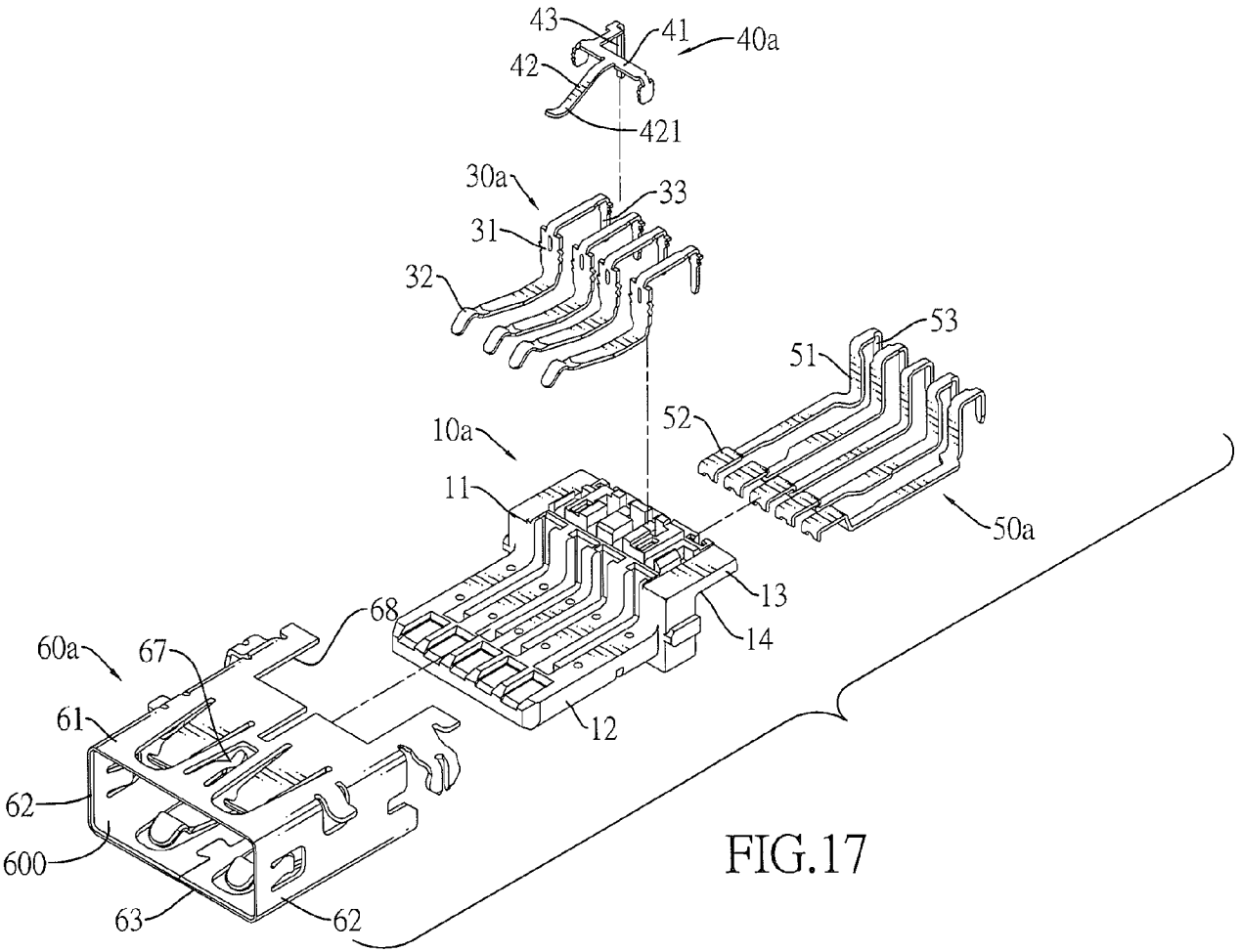
FIG. 17 is an exploded perspective view of the sink-type receptacle connector in FIG. 14.
Figure 18:
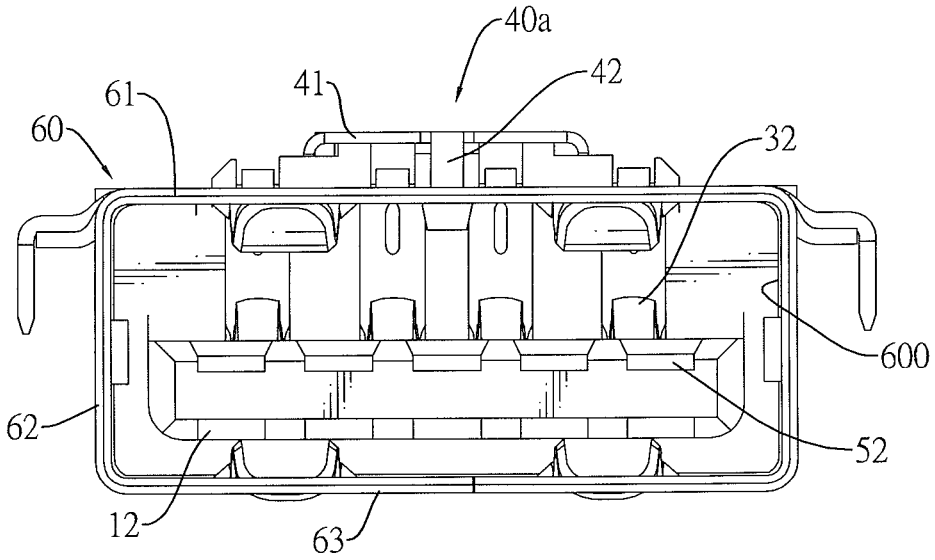
FIG. 18 is a front view of the sink-type receptacle connector in FIG. 14.
Figure 19:
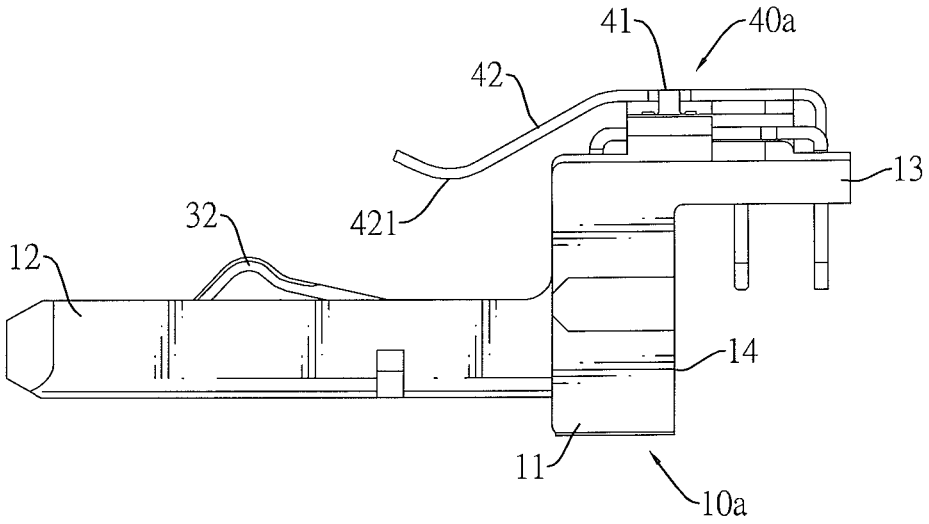
FIG. 19 is a side view of the sink-type receptacle connector in FIG. 16.

With reference to FIGS. 11 to 13, a fourth embodiment of the standard receptacle connector in accordance with the present invention is similar to the first embodiment and has several modifications. The mounting slot (115) is defined in the top (111) of the base (11) of the insulating housing (10). The mounting segment (41) of the plug detecting terminal (40) is mounted in the mounting slot (115).

With reference to FIGS. 15 to 19, a first embodiment of a sink-type receptacle connector in accordance with the present invention complies with the USB 3.0 protocol and may be connected to a plug connector (90). The sink-type receptacle connector comprises an insulating housing (10*a*), multiple first terminals (30*a*), multiple second terminals (50*a*), a plug detecting terminal (40*a*) and a shell (60*a*).

The insulating housing (10*a*) has a base (11), a tongue (12), a tailboard (13) and a printed circuit board (PCB) mounting slot (14). The base (11) has a front, a rear, a top (111), a bottom (113) and two opposite sides (112).

The tongue (12) is formed on and protrudes forward from the front of the base (11) and has a bottom surface.

The tailboard (13) is formed on and protrudes backward from the rear of the base (11).

The PCB mounting slot (14) is defined behind the rear of the base (11) and under the tailboard (13) and may engage with an edge of a PCB.

The first terminals (30*a*) are mounted on the insulating housing (10) and are capable of implementing USB 2.0 protocol. Each first terminal (30) has a first mounting section (31), a first contacting section (32) and a first soldering section (33).

The first mounting section (31) is mounted on the base (11).

The first contacting section (32) is formed on and protrudes forward from the first mounting section (31) and is mounted on the bottom surface of the tongue (12).

The first soldering section (33) is formed on and protrudes down from the first mounting section (31) and is mounted through the tailboard (13).

The second terminals (50*a*) are mounted on the insulating housing (10) and are capable of cooperating with the first terminals (30*a*) to implement USB 3.0 protocol. Each second terminal (50*a*) has a second mounting section (51), a second contacting section (52) and a second soldering section (53).

The second mounting section (51) is mounted on the base (11).

The second contacting section (52) is formed on and protrudes forward from the second mounting section (51) and is mounted on the bottom surface of the tongue (12).

The second soldering section (53) is formed on and protrudes down from the second mounting section (51) and is mounted through the tailboard (13).

The plug detecting terminal (40*a*) is mounted on the insulating housing (10*a*) and has a mounting segment (41), a resilient detecting arm (42) and a soldering segment (43).

The mounting segment (41) is mounted on the top (111) of the base (11) of the insulating housing (10*a*) and has two side ends and two embedding tabs (411). The embedding tabs (411) are formed respectively on and protrude downward from the side ends of the mounting segment (41) and are embedded in the base (11). Each embedding tab (411) has multiple teeth formed on the embedding tab (411) and biting the base (11).

The resilient detecting arm (42) is formed on and protrudes forward from the mounting segment (41) above the tongue (12) and has a distal end and a contacting protrusion (421). The contacting protrusion (421) is formed on the distal end of the resilient detecting arm (42) and protrudes toward the tongue (12) of the insulating housing (10*a*).

The soldering segment (43) is formed on and protrudes down from the mounting segment (41).

The shell (60*a*) may be made of metal, covers the insulating housing (10*a*) and has a cavity (600), a top plate (61), two opposite side plates (62) and a bottom plate (63) that are similar to those of the aforementioned standard receptacle connector. The top plate (61) has a top opening (68) defined through the top plate (61) and aligned with the resilient detecting arm (42) of the plug detecting terminal (40*a*) so that the resilient detecting arm (42) extends through the top opening (68) from an outside wall to the inside wall of the top plate (61).

Figure 20:
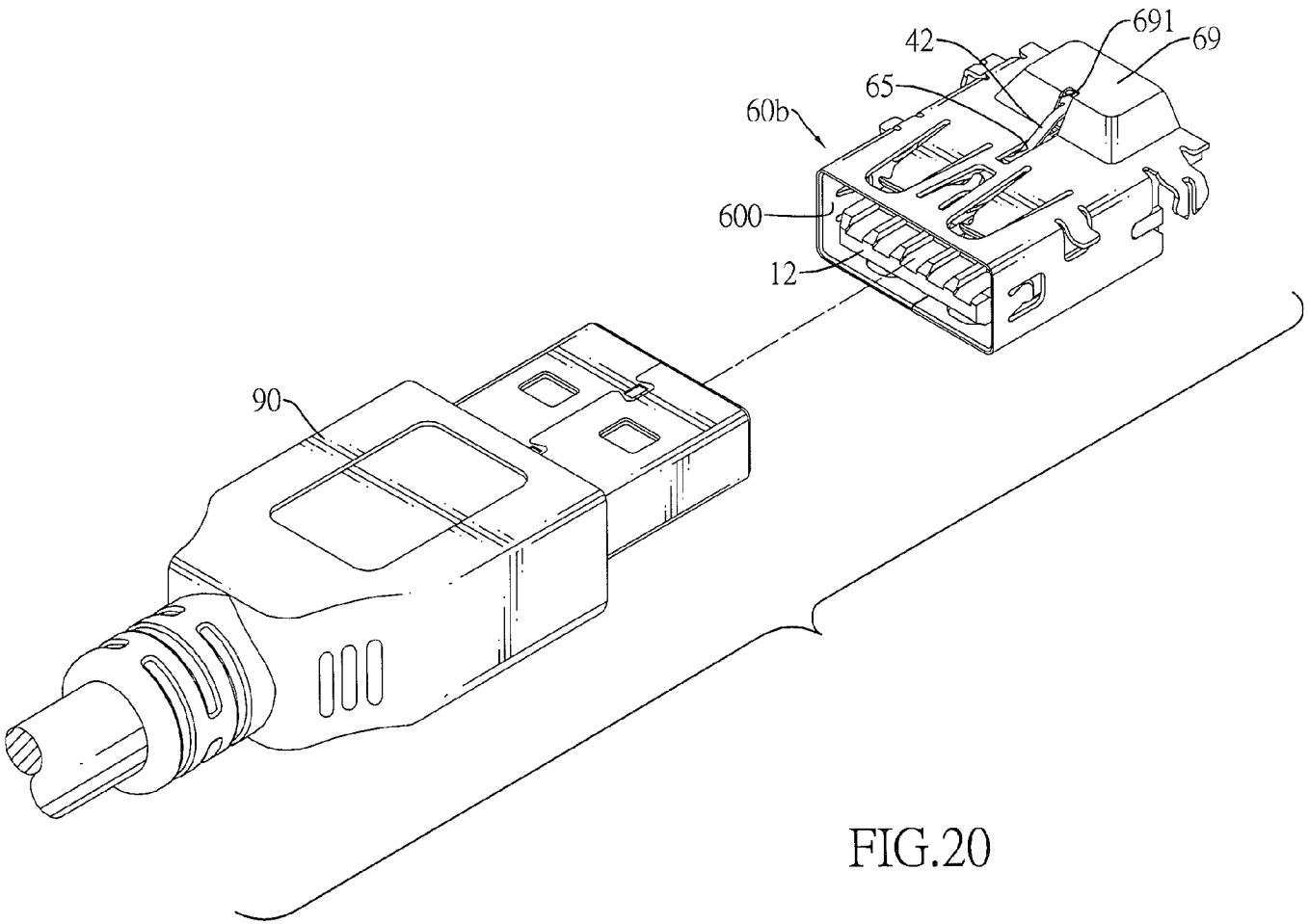
FIG. 20 is an exploded perspective view of a second embodiment of the sink-type receptacle connector with plug detecting functions in accordance with the present invention when connected to a plug connector.

With reference to FIG. 20, a second embodiment of the sink-type receptacle connector in accordance with the present invention is similar to the first embodiment and modifies the shell (60*b*). The shell (60*b*) further has a cap (69) formed on and protruding from the top opening (68) and having a slit (691) defined through the cap (69) and allowing the resilient detecting arm (42) to extend through the slit (691). The cap (69) protects the plug detecting terminal (40*a*) from electromagnetic interference.

The aforementioned standard/sink-type receptacle connector may be mounted on a PCB such as a motherboard of a computer. The plug detecting terminal (40, 40*a*) is connected electrically to a controlling circuit of the PCB. When a plug connector (90) is inserted in and connected to the standard/sink-type receptacle connector, a metal shell of the plug connector (90) electrically contacts the plug detecting terminal (40, 40*a*) to activate the controlling circuit. The activated controlling circuit provides the plug connector (90) with power. When no plug connector (90) is inserted into the cavity (600) of the standard/sink-type receptacle connector, the controlling circuit is deactivated and stops supplying power to the plug connector (90).

Therefore, the standard/sink-type receptacle connector incorporated with the plug detecting terminal (40, 40*a*) selectively provides or cuts power to external plug connectors to achieve the power saving purposes. The standard/sink-type receptacle connector may cooperate with the power-saving/standby mode of a motherboard. Even if the motherboard is under the power-saving/standby mode, the standard/sink-type receptacle connector on the motherboard is still allowed to provide external plug connectors with power instantly.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A receptacle connector with plug detecting functions, the receptacle connector comprising:
- an insulating housing having
  - a base having a front, a rear, a top, a bottom and two opposite sides; and
  - a tongue formed on and protruding forward from the front of the base;
- multiple first terminals mounted on the insulating housing and capable of implementing USB 2.0 protocol;
- a plug detecting terminal mounted on the insulating housing and having
  - a mounting segment mounted on the base of the insulating housing and having
    - two side ends; and
    - two embedding tabs formed respectively on and protruding upward from the side ends of the mounting segment and embedded in the base;
  - a resilient detecting arm formed on and protruding forward from the mounting segment; and
  - a soldering segment formed on and protruding down from the mounting segment; and
- a shell having a cavity defined through the shell and covering the insulating housing and the multiple first terminals.

2. The-receptacle connector as claimed in claim 1, wherein each embedding tab has multiple teeth formed on the embedding tab and biting the base.

3. The receptacle connector as claimed in claim 1 further comprising multiple second terminals mounted on the insulating housing, wherein the cavity of the shell covers the second terminals.

4. The receptacle connector as claimed in claim 1, wherein the resilient detecting arm of the plug detecting terminal has a distal end and a contacting protrusion formed on the distal end of the resilient detecting arm and protruding toward the tongue of the insulating housing.

5. A receptacle connector with plug detecting functions, the receptacle connector comprising:
- an insulating housing having
  - a base having a front, a rear, a top, a bottom and two opposite sides; and
  - a tongue formed on and protruding forward from the front of the base;
- multiple first terminals mounted on the insulating housing;

a plug detecting terminal mounted on the insulating housing and having a mounting segment mounted on the base of the insulating housing and having two side ends; and two embedding tabs formed respectively on and protruding upward from the side ends of the mounting segment and embedded in the base;

a resilient detecting arm formed on and protruding forward from the mounting segment; and a soldering segment formed on and protruding down from the mounting segment; and a shell having a cavity defined through the shell and covering the insulating housing and the multiple first terminals.

6. The-receptacle connector as claimed in claim 5, wherein each embedding tab has multiple teeth formed on the embedding tab and biting the base.

7. The receptacle connector as claimed in claim 6 further comprising multiple second terminals mounted on the insulating housing, wherein the cavity of the shell covers the second terminals.

8. The receptacle connector as claimed in claim 7, wherein the resilient detecting arm of the plug detecting terminal has a distal end and a contacting protrusion formed on the distal end of the resilient detecting arm and protruding toward the tongue of the insulating housing.

9. The receptacle connector as claimed in claim 7, wherein the multiple first terminals are capable of implementing USB 2.0 protocol.

10. The receptacle connector as claimed in claim 9, wherein the shell further has a top plate;

two opposite side plates formed oppositely on and protruding down from the top plate;

a bottom plate formed between the side plates; and a resilient tightening tab formed on the top plate and protruding toward the cavity.

11. A receptacle connector with plug detecting functions, the receptacle connector comprising:

an insulating housing having a base having a front, a rear, a top, a bottom and two opposite sides; and a tongue formed on and protruding forward from the front of the base;

multiple first terminals mounted on the insulating housing;

a plug detecting terminal mounted on the insulating housing and having a mounting segment mounted on the base of the insulating housing and having at least one embedding tab formed on and protruding upward from the mounting segment and embedded in the base;

a resilient detecting arm formed on and protruding forward from the mounting segment; and a soldering segment formed on and protruding down from the mounting segment; and a shell having a cavity defined through the shell and covering the insulating housing and the multiple first terminals.

12. The-receptacle connector as claimed in claim 11, wherein the embedding tab has multiple teeth formed on the embedding tab and biting the base.

13. The receptacle connector as claimed in claim 12 further comprising multiple second terminals mounted on the insulating housing, wherein the cavity of the shell covers the second terminals.

14. The receptacle connector as claimed in claim 13, wherein the multiple first terminals are capable of implementing USB 2.0 protocol.

15. The receptacle connector as claimed in claim 14, wherein the resilient detecting arm of the plug detecting terminal has a distal end and a contacting protrusion formed on the distal end of the resilient detecting arm and protruding toward the tongue of the insulating housing.

16. The receptacle connector as claimed in claim 15, wherein the shell further has a top plate;

two opposite side plates formed oppositely on and protruding down from the top plate;

a bottom plate formed between the side plates; and a resilient tightening tab formed on the top plate and protruding toward the cavity.

17. The receptacle connector as claimed in claim 16, wherein each first terminal has a first mounting section mounted on the base;

a first contacting section formed on and protruding forward from the first mounting section and mounted on the bottom surface of the tongue; and a first soldering section formed on and protruding down from the first mounting section; and each second terminal has a second mounting section mounted on the base;

a second contacting section formed on and protruding forward from the second mounting section and mounted on the bottom surface of the tongue; and a second soldering section formed on and protruding down from the second mounting section.

18. The receptacle connector as claimed in claim 17 further comprising a protection bracket mounted under the base of the insulating housing and having multiple through holes defined through the protection bracket and mounted respectively around the first soldering sections, the second soldering sections and the soldering segment.

19. The receptacle connector as claimed in claim 18 further comprising a protection bracket mounted under the base of the insulating housing and having multiple through holes defined through the protection bracket and mounted respectively around the first soldering sections, the second soldering sections and the soldering segment.

20. The receptacle connector as claimed in claim 19, wherein the second terminals are capable of cooperating with the multiple first terminals to implement USB 3.0 protocol.

* * * * *